US008877132B2

(12) United States Patent
Johnson et al.

(10) Patent No.: US 8,877,132 B2
(45) Date of Patent: Nov. 4, 2014

(54) BAFFLES FOR IMPROVING RISER HYDRODYNAMICS

(75) Inventors: Daniel R. Johnson, Schaumburg, IL (US); Lev Davydov, Northbrook, IL (US)

(73) Assignee: UOP LLC, Des Plaines, IL (US)

( * ) Notice: Subject to any disclaimer, the term of this patent is extended or adjusted under 35 U.S.C. 154(b) by 418 days.

(21) Appl. No.: 13/452,093

(22) Filed: Apr. 20, 2012

(65) Prior Publication Data

US 2013/0280138 A1 Oct. 24, 2013

(51) Int. Cl.

| | |
|---|---|
| ***B01J 8/18*** | (2006.01) |
| *B01J 8/00* | (2006.01) |
| *B01J 8/08* | (2006.01) |
| *B01J 19/00* | (2006.01) |
| *B01J 19/24* | (2006.01) |
| *F27B 15/00* | (2006.01) |
| *F27B 15/02* | (2006.01) |

(52) U.S. Cl.

USPC ..... 422/139; 422/129; 422/140; 422/141; 422/142; 422/143; 422/144; 422/145; 422/146; 422/147

(58) Field of Classification Search

CPC ..... B01J 8/00; B01J 8/008; B01J 8/08; B01J 8/18; B01J 19/00; B01J 19/24; F27B 15/00; F27B 15/02; C10G 1/00

USPC ..... 422/129, 139–147; 208/46, 106, 113, 208/146, 153, 176

See application file for complete search history.

(56) References Cited

U.S. PATENT DOCUMENTS

| | | | | |
|---|---|---|---|---|
| 3,353,925 | A * | 11/1967 | Baumann et al. | 422/214 |
| 4,086,064 | A | 4/1978 | MacLean et al. | |
| 5,173,175 | A | 12/1992 | Steffens et al. | |
| 5,417,932 | A | 5/1995 | Castagnos et al. | |
| 5,851,380 | A * | 12/1998 | Wells | 208/158 |
| 6,146,519 | A * | 11/2000 | Koves | 208/146 |
| 6,454,933 | B2 | 9/2002 | Ito et al. | |
| 6,596,242 | B1 * | 7/2003 | Dries | 422/139 |
| 6,669,104 | B2 | 12/2003 | Koveal et al. | |
| 7,179,427 | B2 | 2/2007 | Marchant et al. | |
| 7,658,889 | B2 | 2/2010 | Roux et al. | |
| 7,935,314 | B2 | 5/2011 | Couch et al. | |
| 7,964,157 | B2 | 6/2011 | Dries et al. | |
| 8,062,507 | B2 | 11/2011 | Lambin et al. | |
| 2011/0198267 | A1 | 8/2011 | Couch et al. | |

FOREIGN PATENT DOCUMENTS

| | | |
|---|---|---|
| WO | WO 99/43425 A1 | 9/1999 |

* cited by examiner

*Primary Examiner* — Natasha Young
(74) *Attorney, Agent, or Firm* — James C Paschall

(57) ABSTRACT

Fluid catalytic cracking units having risers with improved hydrodynamics through the use of baffles are described. The baffles break up the high concentration of catalyst in the slower moving outer annulus and redistribute it into the faster moving, more dilute center of the riser flow.

20 Claims, 5 Drawing Sheets

BAFFLES FOR IMPROVING RISER HYDRODYNAMICS

BACKGROUND OF THE INVENTION

This invention relates generally to fluid catalytic cracking units, and more particularly to fluid catalytic cracking units having risers with improved hydrodynamics through the use of baffles.

In a fluid catalytic cracking (FCC) unit such as illustrated in FIG. 1, hydrocarbons are contacted in a reaction zone with a catalyst composed of finely divided particulate material. Inert diluent, such as steam, enters the riser and is mixed with catalyst. The hydrocarbon feed and an inert diluent, such as steam, are introduced to the riser 10 by a hydrocarbon feed distributor 5 which atomizes the hydrocarbon feed as it enters the riser 10. The hydrocarbon feed and inert diluent fluidize the catalyst and transport it in the riser 10. The catalyst promotes the cracking reaction. As the cracking reaction proceeds, a substantial amount of highly carbonaceous material, referred to as coke, is deposited on the catalyst. The coke-containing catalyst is separated from the hydrocarbon product in a separation zone 20 and removed from the reactor through conduit 30, while the hydrocarbon product exits through the top of the reactor. The coke is burned from the catalyst by contact with an oxygen-containing stream that serves as a fluidization medium in a high temperature regeneration zone 25. Coke-containing catalyst is replaced by essentially coke-free catalyst from the regeneration zone 25 through conduit 35. In some FCC units, there is a conduit 40 in which a portion of the catalyst is recycled without going through the regeneration zone 25.

FCC risers have traditionally suffered from vapor-catalyst slip caused by the inherent non-uniformities of upward moving particle-containing flows. These non-uniformities manifest themselves primarily as core-annular structures: the core of the flow is dilute and moves upward at a higher velocity, while there is a high concentration of catalyst near the wall which forms a dense, slow-moving annulus. The annulus can actually move downward in some cases. This annular flow results in decreased conversion in the riser because the faster moving dilute core under-converts the feed and the slower moving and/or downward moving annulus over-cracks the primary FCC products, leading to increased dry gas production.

SUMMARY OF THE INVENTION

One aspect of the invention is a riser reactor. In one embodiment, the riser reactor includes a vertical riser having a hydrocarbon feed inlet; and a row of baffles located more than 6 m above the hydrocarbon feed inlet, a front face of the baffle facing the center of the riser, a lower end of the baffle attached to a wall of the riser and the baffle inclined inward from the wall at an angle of about 90° or less.

In another embodiment, the riser reactor includes a vertical riser having a hydrocarbon feed inlet; and a row of baffles located more than 6 m above the hydrocarbon feed inlet, a front face of the baffle facing the center of the riser, a lower end of the baffle attached to a wall of the riser, and the baffle inclined inward from the wall at an angle of about 90° or less.

DETAILED DESCRIPTION OF THE INVENTION

The use of baffles in the mixing zone of the riser alters the flow profile so that it approaches true plug flow, alleviating the problems associated with the core-annulus structure. The baffles break up the outer annulus and redistribute the catalyst into the center of the riser flow. This results in higher conversion in the riser and less overcracking of the products.

The attachment of baffles to the riser wall in the mixing zone above the hydrocarbon feed inlet has been shown to make the catalyst holdup distribution in the riser more uniform using Computational Flow Dynamics (CFD) computer simulation. The baffles also improve the flow profile in the riser by slowing down the upward core flow, which results in less short-circuiting. In addition, the baffles minimize the downward flow of the annulus.

Figure 2A:
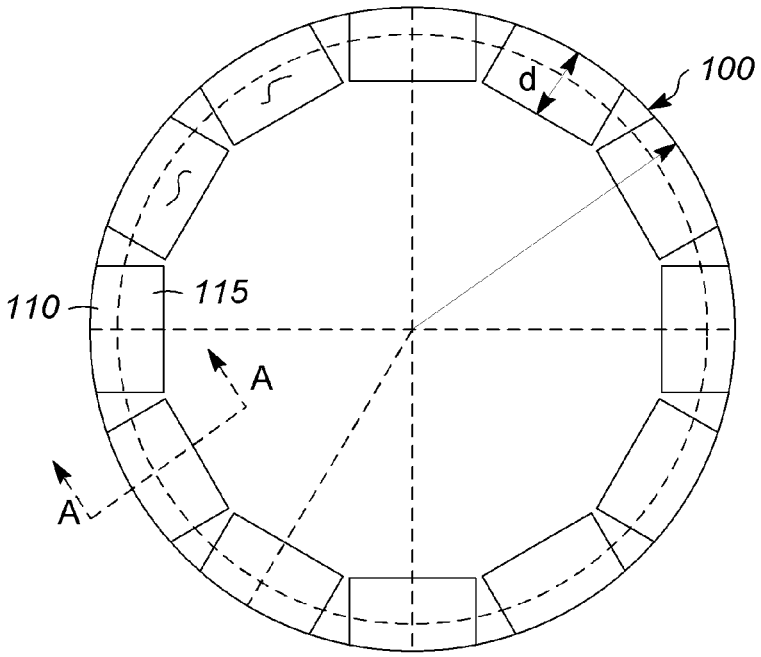
FIG. 2A is a cross-section of one embodiment of a riser pipe with internal baffles.

FIG. 2A shows one embodiment of a riser 100 having a row of baffles 115 extending inward from the wall 110. The front face 140 of the baffles is facing the center of the riser. As shown, the baffles 115 are equally spaced around the circumference of the riser 100 and cover substantially the whole circumference of the riser.

In one embodiment, the baffles are positioned symmetrically around the circumference of the riser. In another embodiment, the baffles are arranged non-symmetrically.

In some embodiments, the baffles can cover less of the circumference, if desired. For example, typically at least about 30% of the circumference is covered with baffles, or at least about 40%, or at least about 50%, or at least about 60%, or at least about 70%, or at least about 80%, or at least about 90%, or at least about 95%.

The baffles extend inward from the wall a distance d up to about 25% of the radius R of the riser, typically in the range of about 15% to about 25%. The baffles desirably extend over about ⅛ of the cross-sectional area of the riser 110.

The baffles are typically in the range of about 0.15 to about 0.30 m in length. The length depends in part on the radius of the riser and the angle from the wall.

The angle of the baffle (about 90° from vertical or less) coupled with the ceramic lining ensure the erosion resistance of the attachment.

The riser desirably has at least two rows of baffles along its length so that the core-annulus structure does not return to its original state as it flows up the riser. However, if there are too many rows of baffles, the catalyst-laden vapors flowing upward will simply bypass the baffles altogether, effectively reducing the diameter of the riser.

Figure 2B:
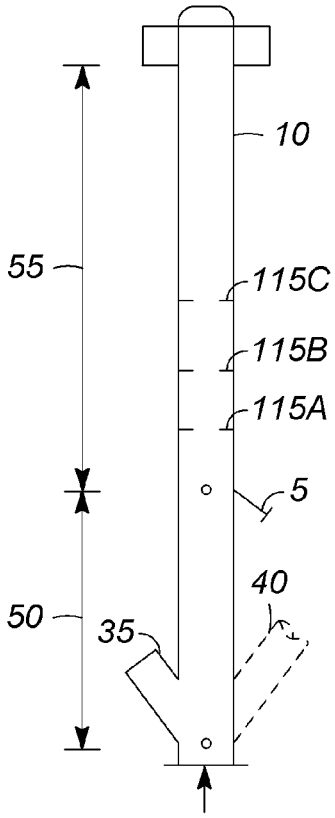
FIG. 2B is an illustration of one embodiment of a riser pipe with internal baffles.

FIG. 2B illustrates a riser pipe 10 with three rows of internal baffles 115A, 115B, and 115C. The riser pipe 10 has a lift zone 50 and a reaction zone 55. The regenerated catalyst enters the lift zone 50 through conduit 35, and the recycled catalyst (if present) enters through conduit 40. The hydrocarbon feed enters through the feed distributer 5 which separates the lift zone 50 from the reaction zone 55. Three rows of baffles 115A, 115B, and 115C are located in the riser pipe 10. As an example, the lift zone 50 could be about 10 m, and the reaction zone about 20 m. The first row of baffles 115A could be about 6 m above the feed distributor 5, with a second row of baffles 115B about 5 m above the first, and a third row 115C about 5 m above the second row.

There are typically up to three rows of baffles for a riser that is about 30 m high. The first row of baffles is located more than about 6 m above the highest feed inlet in the riser (steam, hydrocarbon, catalyst, etc.), typically in the range of about 6 m to about 6.5 m above the feed inlet(s). Additional rows can be positioned at evenly spaced intervals, e.g., about 5 m apart. The separation between the rows will vary depending on the length of the riser, the number of rows of baffles, and whether any of the rows are divided into subsets as discussed below. Generally, the rows will be in the range of about 5 m to about 10 m apart. In one embodiment, the baffles are arranged in the same position around the circumference for all of the rows. In another embodiment, the baffles in one row are offset from the baffles in the previous row.

In one embodiment, each row has the same number of baffles. In another embodiment, there can be a different number of baffles in at least two rows.

The bottom of the baffle is attached to the wall of the riser, for example, by welding. The baffles are inclined inward from vertical at an angle b of up to about 90°. In one embodiment, the baffles are inclined from the vertical at an angle of about 90°. In another embodiment, the baffles are inclined in a range of about 10° to about 45°.

Figure 3:
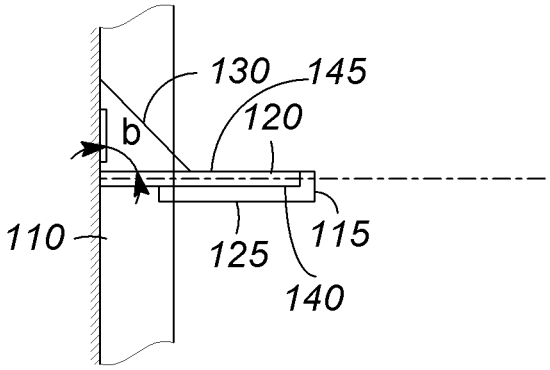
FIG. 3 is a sectional view along A-A of FIG. 2A of one embodiment of a baffle.

FIG. 3 shows a one embodiment of a baffle 115. The baffle 115 has a support plate 120. The support plate 120 has a ceramic liner 125 on the upper end and the front face 140 (the side facing the upward flow). The baffle is typically welded to the riser 110 forming an angle b of about 90°. The baffle 115 can be supported by a support 130, if desired. The support 130 can be metal plate welded to the wall 110 and the support plate 120, for example.

Figure 4:
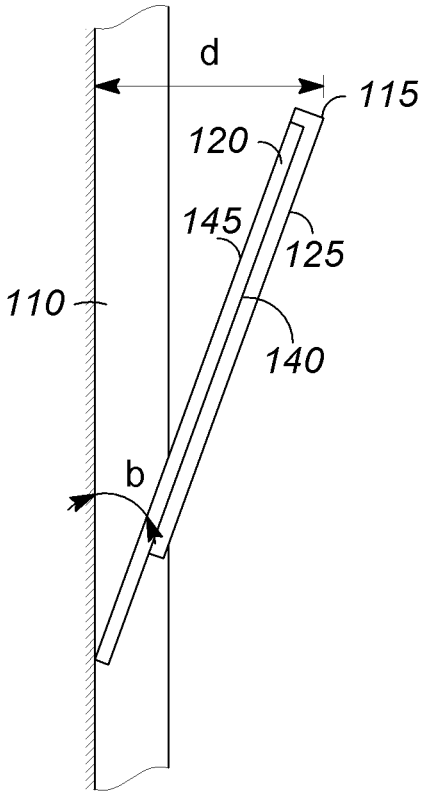
FIG. 4 is a sectional view along A-A of FIG. 2A of another embodiment of a baffle.

FIG. 4 shows another embodiment of the baffle 115. In this embodiment, the baffle 115 forms an angle b of between about 10° to about 45° from the side of the riser 110. The support plate 120 is covered on the front face 140 and the upper end by ceramic 125.

A number of factors can be considered in determining the appropriate angle for the baffles in a particular riser. One consideration is mixing, with larger angles producing greater mixing. Another factor is the amount of erosion, which is greater for larger angles. Still another factor is the pressure drop generated by the baffles, which is greater for baffles having larger angles than for those with smaller angles. In addition, the effect of thermal differential growth should be evaluated. When the angle b is about 90°, the wall and the baffle might expand at different rates, which could potentially lead to cracking. With smaller angles, such as about 10° to about 45°, the relatively long inclined support plate provides a longer path for heat transfer. This minimizes the thermal differential growth of the baffle, especially under transient conditions, such as start-up or shut-down.

Figure 5:
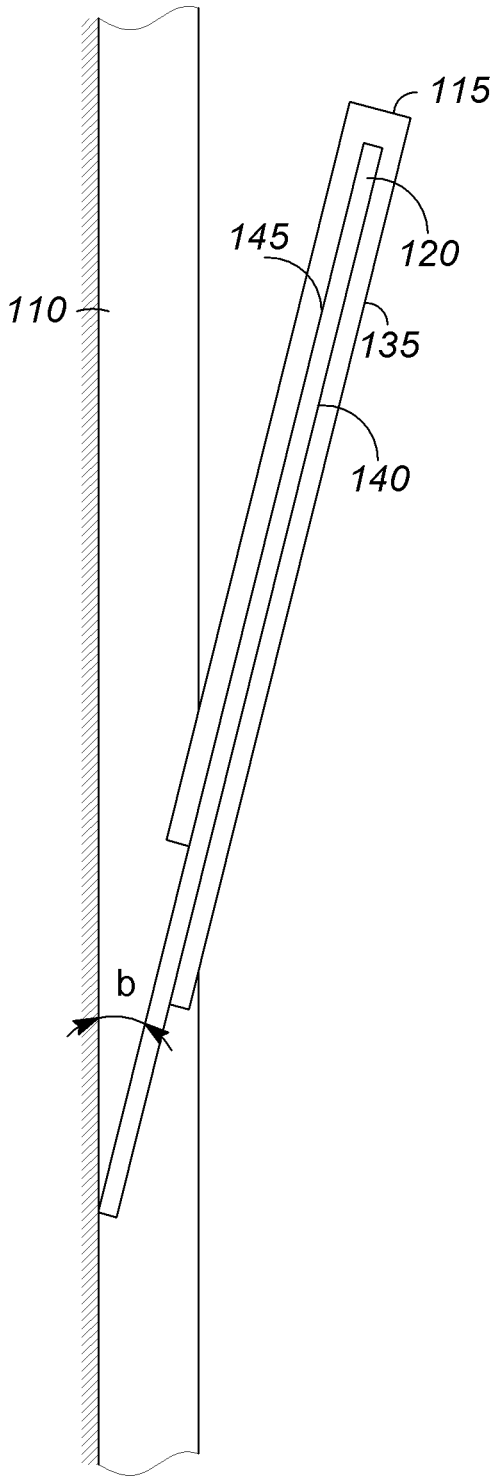
FIG. 5 is a sectional view along A-A of FIG. 2A of another embodiment of a baffle.

FIG. 5 shows another embodiment of the baffle 115. A ceramic sleeve 135 covers the front and back faces 140, 145 of the support plate 120. The ceramic sleeve 135 is attached to the support plate. Erosion resistance is improved because both sides of the support plate 120 are covered with ceramic.

Figure 6A:
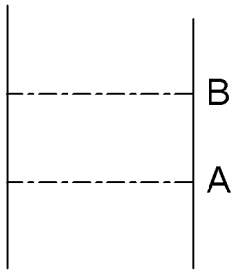
FIGS. 6A-C are illustrations of one embodiment of two subsets of a row of baffles.
Figure 6B:
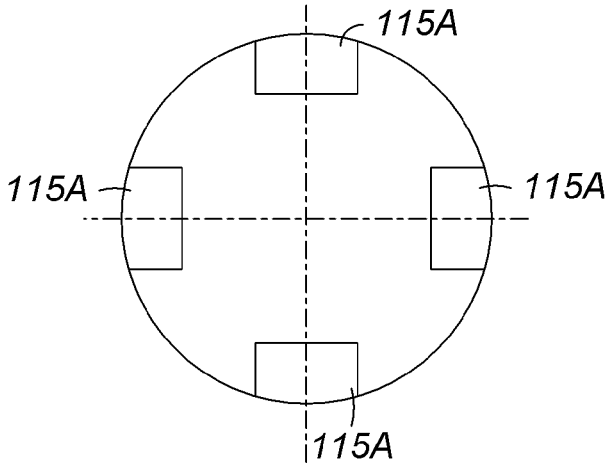
Figure 6C:
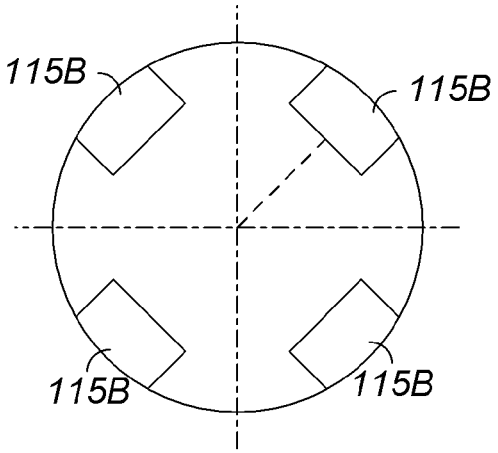

In some embodiments, a row of baffles (or more than one) can be divided into one or more subsets, with each subset being positioned at a different vertical level in the riser, as illustrated in FIGS. 6A-C. As shown in FIG. 6A, subset A is positioned at level A, while subset B is positioned at level B. The baffles 115A in subset A can be angularly offset from the baffles 115B in subset B, as shown in FIGS. 6B-C. As shown, the baffles in subset A are at 90° intervals around the riser. The baffles in subset B are also at 90° intervals, but they are offset 45° from the baffles of subset A. This may help to promote mixing in some embodiments.

Although FIG. 6 shows two subsets with four baffles in each subset and a 45° offset from one level to the next, those of skill in the art will understand that more than two subsets can be used, there can be the same or different numbers of baffles in each subset, and other offset angles can be used as desired.

In one embodiment, the baffles in the subsets can form a stair step arrangement on the riser wall.

In one embodiment, the baffles in the subsets are arranged symmetrically around the riser wall, and in other embodiments, the baffles are arranged non-symmetrically.

The baffles in a subset will generally be within about 1 to 2 m of each other.

The baffles are made of a material having sufficient erosion- and temperature-resistance to withstand the riser conditions. Suitable materials include metal plates, such as stainless steel plates, covered with ceramic on at least the front face facing the upward flow to prevent erosion. The back side away from the flow can be covered with abrasion-resistant refractory. Alternatively, both sides can be covered with ceramic.

The baffles can be made of fusion-cast ceramic tiles with embedded metal, such as Corguard® made by St. Gobain. If an extended metal piece is used during manufacture, the baffles can be welded to the riser wall as shown in FIG. 3, for example. The welding area can then be re-coated with standard FCC riser refractory.

Figure 1:
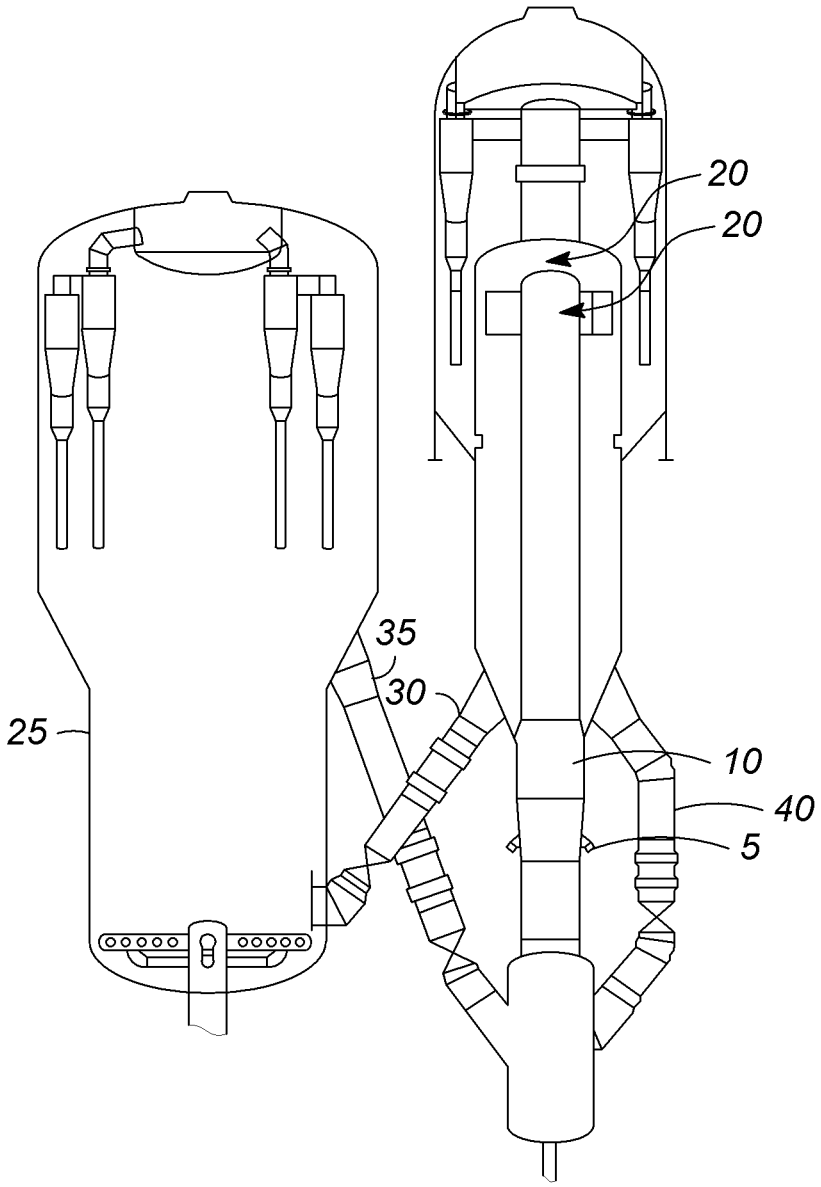
FIG. 1 is an illustration of one embodiment of an FCC unit.

Another method of making the baffles involves welding metal pieces, (e.g., trapezoid-shaped metal pieces) to the riser wall as shown in FIG. 1. Prefabricated ceramic sleeves can then be attached to the welded metal pieces. The ceramic sleeves can be further secured by creating a lip, for example, by bending or welding, on the metal element. Alternatively, they can be additionally secured using a low-expansion cementing compound between the sleeve and the metal element. This method is not limited to the use of Corguard® tiles.

The attachment of the baffles to the riser can take place in situ, if desired. The refractory material inside the riser can be removed manually in the area where the baffles are being installed. The metal pieces would then be welded to the riser wall. The ceramic liner would be attached to the metal piece. The affected areas could then be re-coated with refractory.

It is to be understood that the features of any of the embodiments discussed above may be recombined with any other of the embodiments or features disclosed herein. While particular features and embodiments of a process and reactor system has been shown and described, other variations of the invention will be obvious to those of ordinary skill in the art. All embodiments considered to be part of this invention are defined by the claims that follow.

What is claimed is:

1. A riser reactor comprising:

a vertical riser having a hydrocarbon feed inlet; and a row of baffles located more than about 6 m above the hydrocarbon feed inlet, a front face of the baffle having a ceramic liner facing the center of the riser, a lower end of the baffle attached to a wall of the riser, and the baffle inclined inward from the wall at an angle of about 90° or less.

2. The riser reactor of claim 1 wherein the baffle is inclined inward at the angle of about 90°.

3. The riser reactor of claim 1 wherein the baffle is inclined inward at the angle of about 10° to about 45°.

4. The riser reactor of claim 1 wherein the baffle comprises a support plate with the ceramic liner.

5. The riser reactor of claim 1 wherein the baffle comprises a support plate with a ceramic sleeve covering the front and back faces.

6. The riser reactor of claim 1 wherein there are at least two rows of baffles.

7. The riser reactor of claim 1 wherein the row of baffles comprises at least two subsets of baffles, the first subset at a first position, and the second subset at a second position above the first position.

8. The riser reactor of claim 7 wherein the baffles of the first subset are angularly offset from the baffles of the second subset.

9. The riser reactor of claim 1 wherein the baffles are arranged symmetrically around the wall of the riser.

10. The riser reactor of claim 1 wherein baffles cover substantially the entire circumference of the riser.

11. The riser reactor of claim 1 wherein the baffle extends inward from the wall a distance up to about 25% of a radius of the riser.

12. The riser reactor of claim 1 wherein the baffles are in a range of about 0.15 to about 0.30 m long.

13. The riser reactor of claim 1 further comprising a support attached to the back face of the baffle and to the wall.

14. The riser reactor of claim 1 wherein the baffle comprises a fusion-cast ceramic tile with embedded metal.

15. The riser reactor of claim 1 wherein the back face of the baffle is coated with refractory.

16. A riser reactor comprising:

a vertical riser having a hydrocarbon feed inlet; and a row of baffles located more than about 6 m above the hydrocarbon feed inlet, a front face of the baffle facing the center of the riser, a lower end of the baffle attached to a wall of the riser, and the baffle inclined inward from the wall at an angle of about 90° or less.

17. The riser reactor of claim 16 wherein the baffle is inclined inward at the angle of about 10° to about 45°.

18. The riser reactor of claim 16 wherein the baffle comprises a support plate having a ceramic liner on a front face.

19. The riser reactor of claim 16 wherein the baffle comprises a support plate having a ceramic sleeve covering the front and back faces.

20. The riser reactor of claim 16 wherein the row of baffles comprises at least two subsets of baffles, the first subset at a first position, and the second subset at a second position above the first position.

* * * * *